US005375047A

United States Patent [19]

Mueller

[11] Patent Number: 5,375,047

[45] Date of Patent: Dec. 20, 1994

[54] ILLUMINATED BOW SIGHT

[76] Inventor: Steven M. Mueller, 15731 W. Eldorado Dr., New Berlin, Wis. 53151

[21] Appl. No.: 238,700

[22] Filed: May 5, 1994

[51] Int. Cl.[5] ..... F41G 1/34

[52] U.S. Cl. ..... 362/253; 362/157; 33/265; 124/87

[58] Field of Search ..... 362/110, 157, 253, 190; 33/241, 265; 124/87

[56] References Cited

U.S. PATENT DOCUMENTS

| | | | |
|---|---|---|---|
| 4,195,414 | 4/1980 | Robinson . | |
| 4,220,983 | 9/1980 | Schroeder . | |
| 4,481,717 | 11/1984 | Kowalski | 124/87 |
| 4,521,972 | 6/1985 | Larson . | |
| 4,715,126 | 12/1987 | Holt | 33/265 |
| 4,755,914 | 7/1988 | Bretl et al. . | |
| 4,928,394 | 5/1990 | Sherman | 33/265 |
| 4,977,677 | 12/1990 | Troescher | 124/87 |
| 5,122,932 | 6/1992 | Ziller . | |
| 5,152,068 | 10/1992 | Meister et al. | 33/265 |
| 5,174,269 | 12/1992 | Sappington | 33/265 |
| 5,201,124 | 4/1993 | Sherman | 33/265 |

*Primary Examiner*—Richard R. Cole

[57] ABSTRACT

A bow sight mounting plate is secured to a bow member, wherein the mounting plate includes a plurality of parallel slots. One of the slots has a sight guard secured thereto, with the sight guard having an illumination housing mounted to direct illumination onto an individual or a plurality of associated sight rods, with each of the sight rods having a contrastingly colored head portion for use in sight indication at various distances. In addition, a pressure sensitive switch having an adhesive surface is secured to the archery bow spaced from the mounting plate to effect selective electrical communication between a battery and a light member within the illumination housing during drawing of the bowstring.

4 Claims, 3 Drawing Sheets

ILLUMINATED BOW SIGHT

BACKGROUND OF THE INVENTION

1. Field of the Invention

The field of invention relates to bow sight apparatus, and more particularly pertains to a new illuminated bow sight wherein the same directs illumination onto a bow sight structure for case of viewing during periods of limited available light.

2.Description of the Prior Art

Illuminated bow sight structure is available in the prior art and indicated in U.S. Pat. Nos. 4,521,972; 4,220,983; 4,195,414; and 5,122,932.

The instant invention attempts to overcome deficiencies of the prior art by providing for a bow sight structure arranged for case of mounting and use relative to an archery bow and in this respect, the present invention substantially fulfills this need.

SUMMARY OF THE INVENTION

In view of the disadvantages inherent in the known types of bow sight apparatus now present in the prior art, the present invention provides an illuminated bow sight wherein the same includes a switch arranged for operative communication with an illumination housing to direct illumination onto a plurality of sight pins.

To attain this, the present invention provides a bow sight mounting plate secured to a bow member, wherein the mounting plate includes a plurality of parallel slots. One of the slots has a sight guard secured thereto, with the sight guard having an illumination housing mounted to direct illumination onto an individual or a plurality of associated sight rods, with each of the sight rods having a contrastingly colored head portion for use in sight indication at various distances. In addition, a pressure sensitive switch having an adhesive surface is secured to the archery bow spaced from the mounting plate to effect selective electrical communication between a battery and a light member within the illumination housing during drawing of the bowstring.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is an object of the present invention to provide a new illuminated bow sight which may be easily and efficiently manufactured and marketed.

It is a further object of the present invention to provide a new illuminated bow sight which is of a durable and reliable construction.

An even further object of the present invention is to provide a new illuminated bow sight which is susceptible of a low cost of manufacture with regard to both materials and labor, and which accordingly is then susceptible of low prices of sale to the consuming public, thereby making such illuminated bow sights economically available to the buying public.

Still yet another object of the present invention is to provide a new illuminated bow sight which provides in the apparatuses and methods of the prior art some of the advantages thereof, while simultaneously overcoming some of the disadvantages normally associated therewith.

Even still yet another object of the present invention is to provide a new illuminated bow sight which includes a bow sight mounting plate secured to a bow member, wherein the mounting plate includes a plurality of parallel slots, with an illumination housing to direct illumination onto an individual or a plurality of associated sight rods, with each of the sight rods having a contrastingly colored head portion for use in sight indication at various distances.

Even still yet a further object of the present invention is to provide a new illuminated bow sight which includes a pressure sensitive switch having an adhesive surface secured to the archery bow and spaced from the mounting plate to effect selective electrical communication between a battery and a light member within the illumination housing during drawing of the bowstring.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
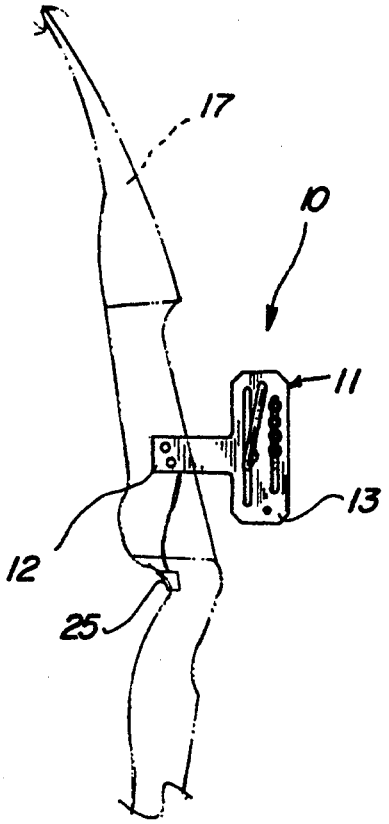
FIG. 1 is an orthographic view of the invention mounted to an archery bow.

With reference now to the drawings, and in particular to FIGS. 1–6 thereof, a new illuminated bow sight embodying the principles and concepts of the present invention and generally designated by the reference numeral 10 will be described.

Figure 2:
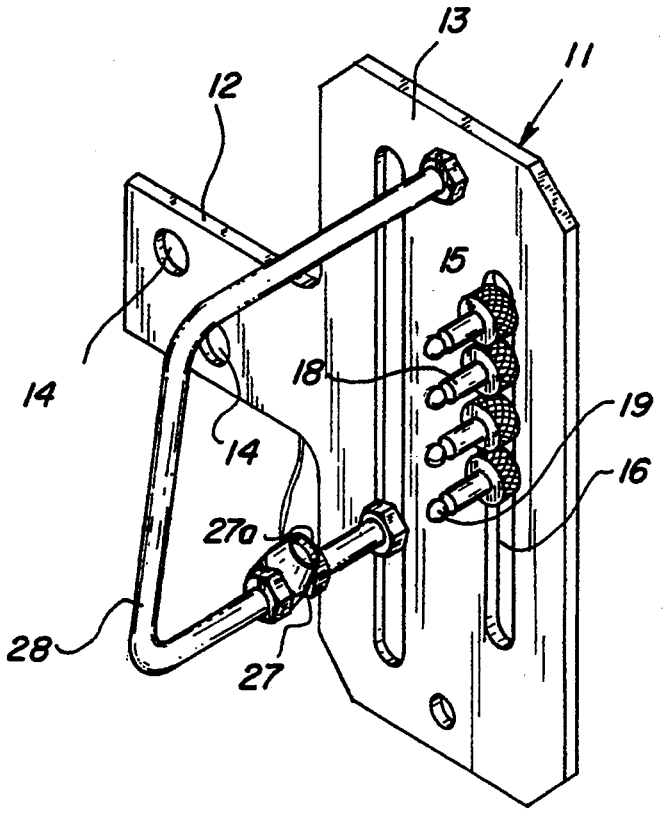
FIG. 2 is an enlarged isometric illustration of the invention.

More specifically, the illuminated bow sight 10 of the instant invention is arranged for mounting to an archery bow 17, as illustrated in FIG. 1, and comprises a mounting plate 11 formed as a first plate 12 integral and coplanar with a second plate 13, as the first plate 12 is secured to the archery bow through first plate apertures 14, of a type as illustrated in FIG. 2, to each receive a respective fastener of any convenient type. It should also be understood that other securement means such as adhesives and the like may be employed to secure the first plate 12 to the bow 17. The second plate is formed to include respective first and second slots 15 and 16 arranged in a parallel relationship relative to one another, with the first slot 15 having secured and extending therefrom a generally U-shaped guard rod 28 that extends from the first slot to an orientation positioned between the first and second slots, as illustrated in FIG. 2.

Figure 3:
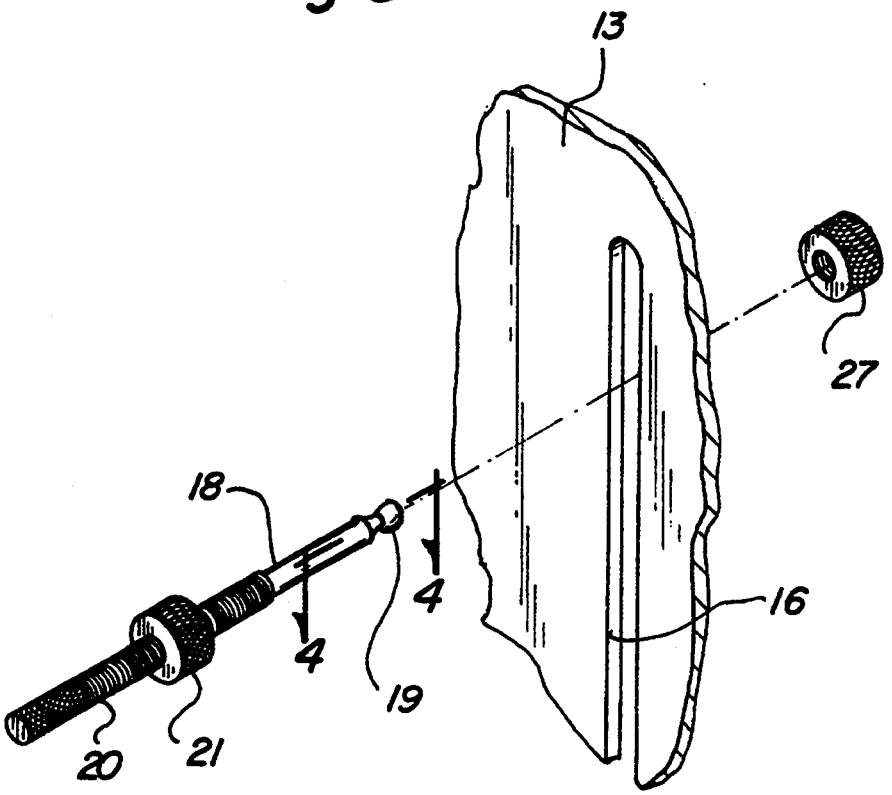
FIG. 3 is an isometric view of a sight pin arranged for securement to the second slot structure.
Figure 4:
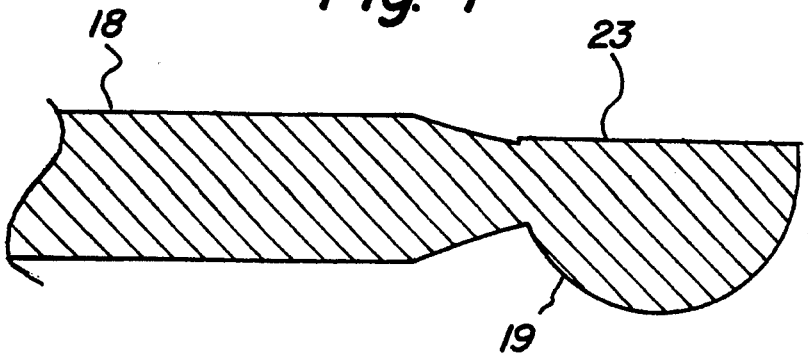
FIG. 4 is an orthographic view, taken along the lines 4–4 of FIG. 3 in the direction indicated by the arrows.
Figure 5:
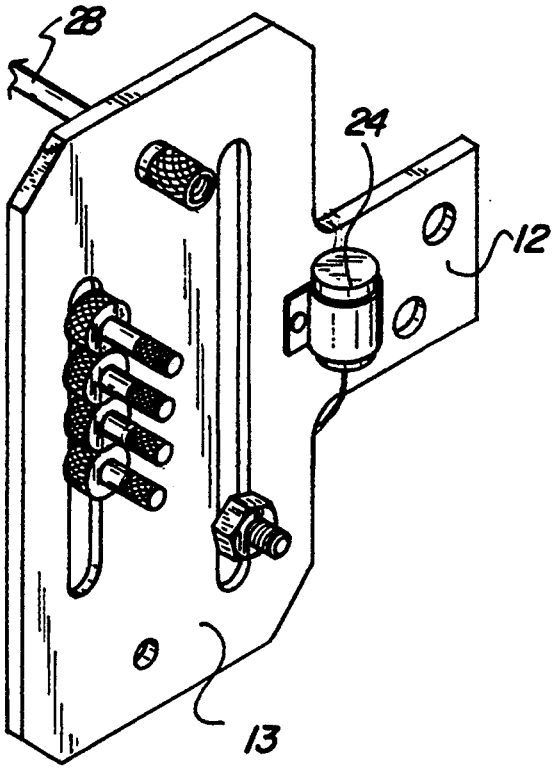
FIG. 5 is an isometric rear view of the mounting plate.
Figure 6:
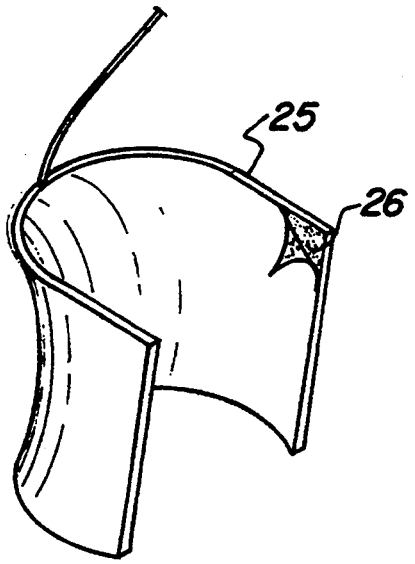
FIG. 6 is an isometric illustration of the pressure sensitive switch structure.

A row of sight rods 18 are directed through the second slot adjacent the U-shaped guard rod 28. As best illustrated in FIGS. 3 and 4, each of the sight rods 18 includes a semi-cylindrical head 19 at a forward end thereof with a threaded shank 20, such that respective first and second fasteners 21 and 22 are mounted to the threaded shank on opposed first and second sides of the second plate 13. The semi-cylindrical head 19 includes a polished, reflective planar wall 23 (see FIG. 4) arranged in a facing relationship to the first slot. The reflective planar walls 23 of the sight rods 18 are arranged to accommodate reflected light from an illumination housing 27 mounted to the U-shaped guard rod 28 that directs light onto the semi-cylindrical heads 19 of the sight rods 18 and direct such reflected light towards an eye of a user of the bow 17. To effect illumination, a battery 24 is mounted to the second side of the second plate (see FIG. 5) and a pressure sensitive switch 25 having an adhesive concave wall surface 26 is secured to the archery bow handle spaced from the mounting plate 11 to effect selective electrical communication between the battery 24 and the light member **27*a* within the illumination housing 27 to direct illumination onto the planar walls 23**.

As to the manner of usage and operation of the instant invention, the same should be apparent from the above disclosure, and accordingly no further discussion relative to the manner of operation of the instant invention shall be provided.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as encompass all such modifications as well as all relationships equivalent to those illustrated in the drawings and described in the specification.

Finally, it will be appreciated that the purpose of the Abstract provided at the beginning of this specification is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. An illuminated bow sight comprising:

a mounting plate, said mounting plate including a first plate arranged for securement to an archery bow, and a second plate integrally mounted to said first plate in a coplanar relationship therewith, said second plate including a first slot and a second slot in a parallel relationship relative to one another;

a U-shaped rigid guard rod mounted to said mounting plate;

an illumination housing secured to said U-shaped guard rod, with said illumination housing having a light member directed in a facing relationship to said second slot;

and, at least one sight rod having a semi-cylindrical head and a threaded shank, said sight rod extending through said second slot, with a plurality of fasteners arranged to secure said threaded shank to said mounting plate on opposed sides of said second slot.

2. An illuminated bow sight as recited in claim 1, wherein said semicylindrical head has a reflective planar wall arranged and oriented to direct illumination from said light member toward an eye of a user holding said bow.

3. An illumination bow sight as recited in claim 2, and further comprising a battery secured to said mounting plate, and a pressure switch mounted to a handle of said bow and spaced from said mounting plate in electrical communication with said light member and said battery to effect selective illumination of said light member during a drawing of a bowstring of said bow.

4. An illuminated bow sight as recited in claim 3, wherein said pressure switch includes a concave wall, with an adhesive directed about said concave wall for securement to said handle of said archery bow.

* * * * *